US007374708B2

(12) United States Patent
Pellicer

(10) Patent No.: US 7,374,708 B2
(45) Date of Patent: May 20, 2008

(54) METHOD OF CONSTRUCTING A LARGE, THREE-DIMENSIONAL, LAMINAR BODY

(76) Inventor: Carlos Fradera Pellicer, Residencial "El Cortalet", Edificio A, Esc. E, L'Aldosa-la Massana (Andorra) (ES)

( * ) Notice: Subject to any disclaimer, the term of this patent is extended or adjusted under 35 U.S.C. 154(b) by 563 days.

(21) Appl. No.: 10/495,372

(22) PCT Filed: Nov. 13, 2002

(86) PCT No.: PCT/ES02/00526

§ 371 (c)(1),
(2), (4) Date: May 12, 2004

(87) PCT Pub. No.: WO03/042030

PCT Pub. Date: May 22, 2003

(65) Prior Publication Data

US 2004/0261937 A1 Dec. 30, 2004

(30) Foreign Application Priority Data

Nov. 14, 2001 (ES) ..... 200102505

(51) Int. Cl.
*B29C 70/00* (2006.01)
*B63B 7/04* (2006.01)

(52) U.S. Cl. ..... 264/227; 264/257; 114/354

(58) Field of Classification Search ..... 264/219, 264/221, 225–227, 324, 257, 258; 114/354
See application file for complete search history.

(56) References Cited

U.S. PATENT DOCUMENTS 1,792,486 A * 2/1931 Feinberg ..... 264/225
3,161,555 A * 12/1964 Kish ..... 156/245
3,282,761 A * 11/1966 Evangelist ..... 156/249
3,372,408 A 3/1968 Luger et al.
3,887,952 A 6/1975 Nicoll, Jr.
4,099,280 A * 7/1978 Hoppe et al. ..... 114/357
4,478,167 A * 10/1984 Hart ..... 114/352
5,376,132 A * 12/1994 Caspers ..... 623/36
5,526,767 A 6/1996 McGuiness et al.
5,529,733 A * 6/1996 Lee ..... 264/73
6,021,732 A 2/2000 Hobbs
6,251,525 B1 * 6/2001 Yau ..... 428/542.2
6,279,425 B1 * 8/2001 Cicotte ..... 76/107.1
6,517,760 B1 * 2/2003 Lazzara ..... 264/219
2002/0043738 A1 * 4/2002 Wu ..... 264/102

FOREIGN PATENT DOCUMENTS

DE 4400535 A1 7/1995
GB 1 062 152 A 3/1967
GB 1 423 068 A 1/1976

* cited by examiner

*Primary Examiner*—Christina Johnson
*Assistant Examiner*—Matthew J. Daniels
(74) *Attorney, Agent, or Firm*—Alston & Bird LLP

(57) ABSTRACT

A method for constructing a three-dimensional laminar body of large dimensions is provided. Starting from a true-to-scale model of the three-dimensional laminar body to be obtained, which comprises the entirety of said body or parts thereof, one or several negative molds which unitarily or together comprise the entire working surface of the three-dimensional laminar body are shaped on the model, and then used to mold, with a fine finish, the entire three-dimensional laminar body or the different constituent parts thereof.

7 Claims, 6 Drawing Sheets

METHOD OF CONSTRUCTING A LARGE, THREE-DIMENSIONAL, LAMINAR BODY

CROSS-REFERENCE TO RELATED APPLICATIONS

This application is a U.S. National Phase application of PCT/ES02/00526; filed Nov. 13, 2002, and claims priority to Spanish Application No. P 200102505; filed Nov. 14, 2001, which are incorporated herein in their entirety by reference.

BACKGROUND OF THE INVENTION

1. Field of the Invention

This invention relates to a process for the construction of a three-dimensional laminar body of large dimensions and in particular those that should have a finely finished visible face or working surface, whether concave or convex, such as vessel hulls and decks, automobile bodywork, swimming pools, etc.

2. Description of Related Art

Until now, bodies designed for the above-mentioned purposes have been constructed in a single piece by lamination of a fiberglass mat impregnated with a polyester which is applied on a polished mold made from wood, plaster, metal or other material and applying pressure through the article's hidden face, the pressure thus being applied on the concave surface in the case of a vessel hull, and on the convex surface in the case of a swimming pool.

Problems experienced are a limitation of the articles' dimensions, by questions of space and volume in transport, and obligatory manual construction on true-to-scale molds, increasing the cost of the product due to the skilled labor necessary and the high level of hygienic working precautions required by the insalubrities of the process.

In light of the above, it would be advantageous to dispose of a process for the manufacture of such products which would allow their construction in any size and configuration, whilst rendering feasible their realization by a mechanical process, whether controlled manually or automatically, of projection molding, deposition, casting, injection, etc.

SUMMARY OF THE INVENTION

With the aim of accomplishing the above objectives, the solution adopted is to break down the final body of the vessel hull, swimming pool or other, into a plurality of parts that, by solid joining thereof, reconstitute the body; such parts having a size that allows their handling, transport and mechanized modeling.

The process which is the subject of the present invention has been developed in accordance with the above solution, and comprises, starting from a true-to-scale model of the three-dimensional laminar body to be obtained, forming the entirety of said body or parts thereof, are shaped on said model one or several first negative molds which unitarily or together comprise the entire working surface of the three-dimensional laminar body; said first negative molds being used to obtain one or several positive molds which reproduce the complete corresponding working surface or a part of the corresponding working surface. Subsequently, said positive molds are used to obtain one or several second negative molds with which is molded the entire three-dimensional laminar body or the sundry parts thereof which constitute, by juxtaposition and mutual solid joining, the three-dimensional laminar body having a finely finished visible face, or working surface.

A feature of the invention is that the first negative mold, should it correspond to the entire three-dimensional laminar body, is compartmentalized with respect to its surface to delimit first negative mold juxtaposable parts, each of which allows the obtention of a positive mold used to create a second negative mold, which has a finely finished working surface and in which is obtained the corresponding part of the three-dimensional laminar body.

Another feature of the invention is constituted by the division into parts of the true-to-scale model of the three-dimensional laminar body to be obtained, each of said parts being used to directly configure a corresponding number of negative molds thereof, each of which is then used to mold a part corresponding to a part of the three-dimensional laminar body to be obtained.

Another feature of the invention is that the parts of the three-dimensional laminar body, configured with the negative molds, comprise mutual coupling provisions, not having a fine finish, including perimetric flanges, those of one part being complementary with those of the contiguous parts, said flanges being substantially perpendicular to or otherwise extending from the hidden faces of each of said parts. Said coupling provisions are capable of being secured to each other by lamination with polyester and/or completed with clamped and/or bolted profiles.

Similarly, a further feature of the invention is that the initial configuration of the three-dimensional laminar body, resulting from the association of a predetermined number of molded parts thereof, can be varied as to its final configuration by the inclusion and/or exclusion of parts thereof.

The invention also provides that the perimetric flanges of each of the parts of the three-dimensional laminar body have projections for positioning with respect to other complementary projections (or receptacles) arranged on the flanges of the parts adjacent to said part.

The invention also provides for the coupling between the ends of the constituent parts of the upper-works being carried out with inclined joints arranged staggered with respect to the bottom joints.

The invention is also characterized in that the molding of the parts of the three-dimensional laminar body is performed, in one manner, by deposition of a layer of fiberglass on the molding surface of a mold and covering such with a flexible countermold which covers the mold and seals it to a certain degree, thus determining a space, with respect to the molding surface, in which the fiberglass is compacted and a vacuum is created, thus facilitating the entry and distribution of a resin which is supplied through entries provided in the countermold.

Similarly, the invention comprises that the layer of fiberglass deposited is of the group including staple fiber, continuous filament matting or fabric, whether considered individually or in their possible combinations, and that the deposition is carried out on a layer of gel-coat resin applied on the molding surface previously administered with a mold release agent.

BRIEF DESCRIPTION OF THE SEVERAL VIEWS OF THE DRAWING(S)

To facilitate understanding of the above concepts, the subject of the invention is described below with reference to the accompanying illustrative drawings, in which.

Figure 5:
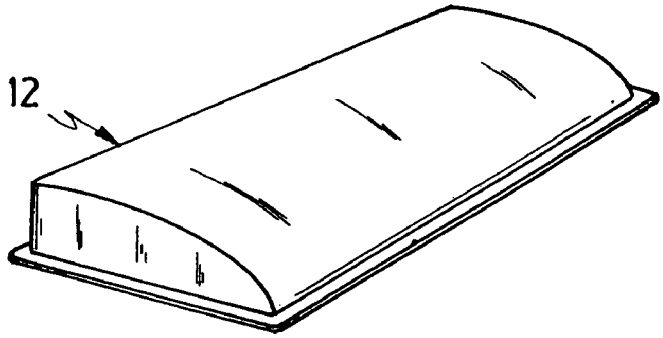
FIG. 5, illustrates, in perspective, a part obtained in the first negative or concave mold, shaped in the body of FIG. 3, which serves as a positive or convex mold.
Figure 6:
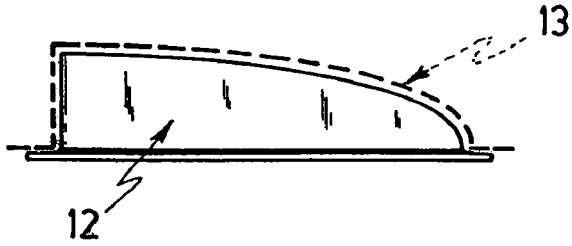
Figure 7:
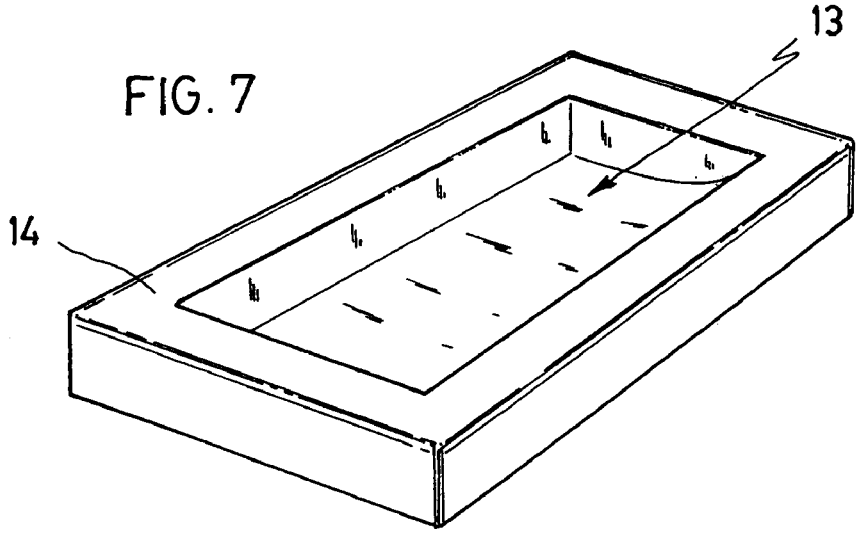
Figure 8:
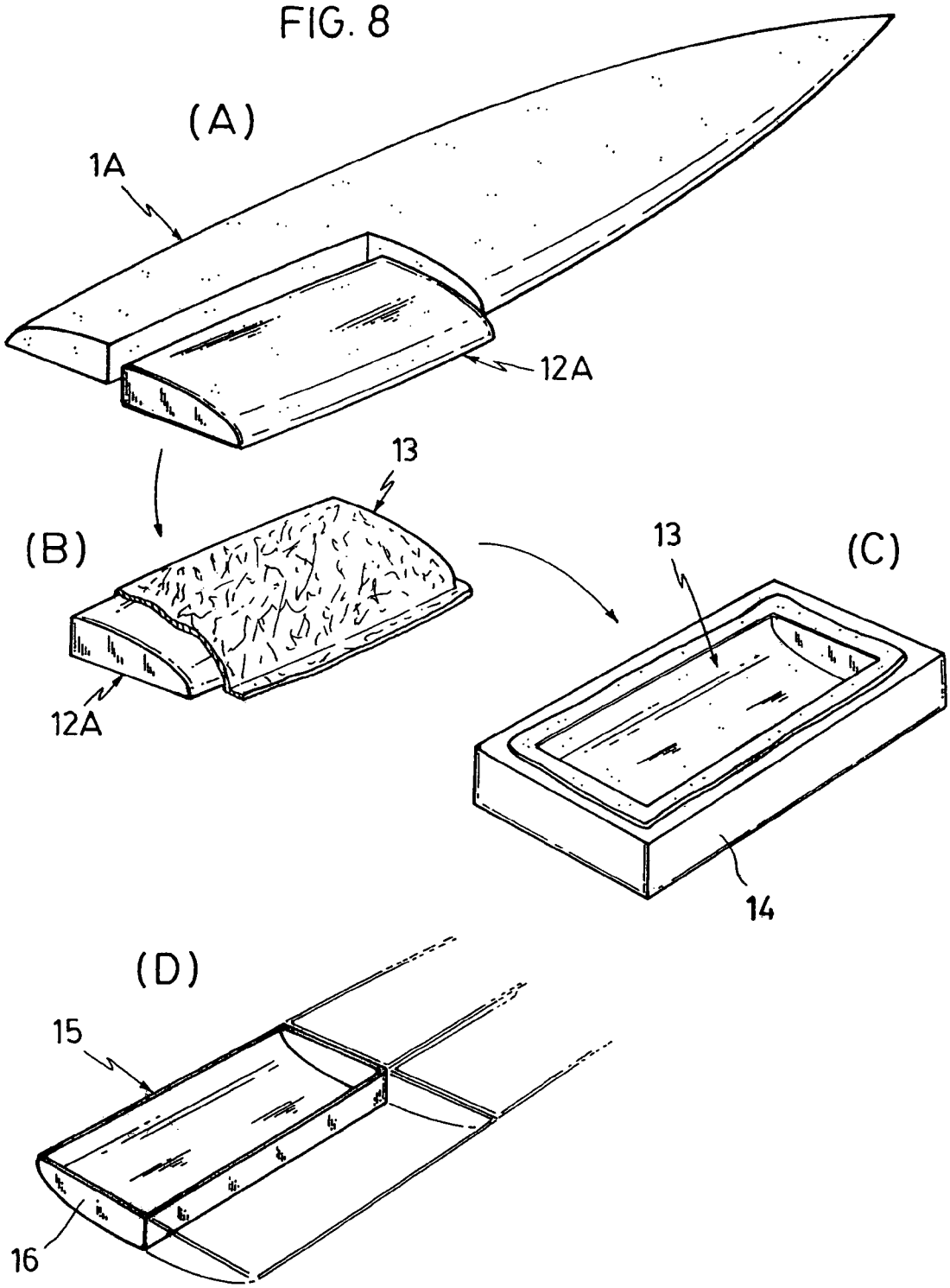
Figure 9:
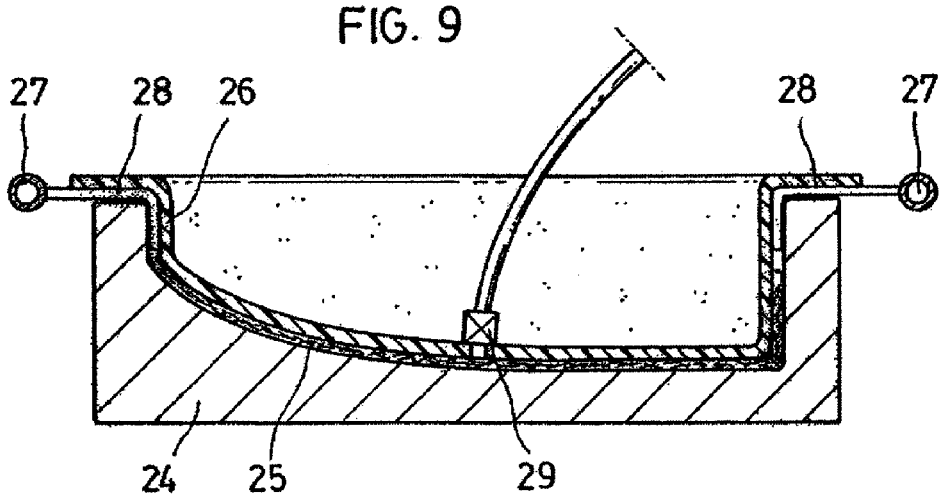
Figure 10:
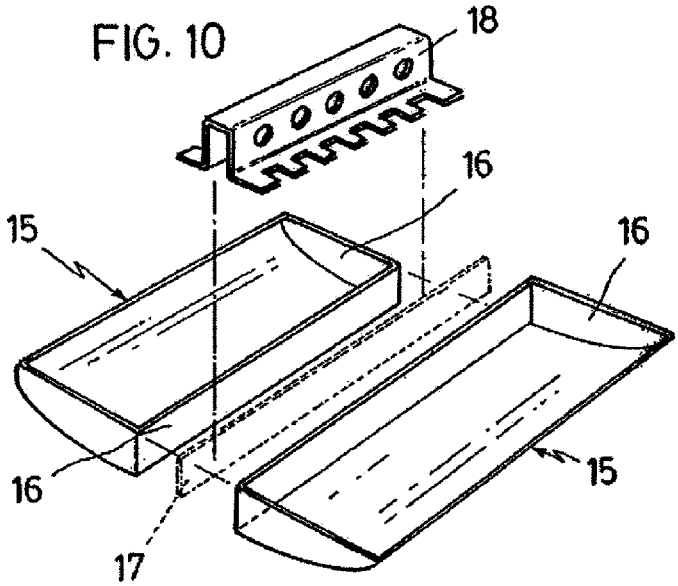
Figure 11:
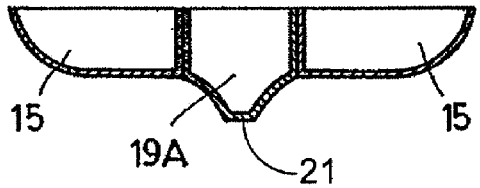
Figure 12:
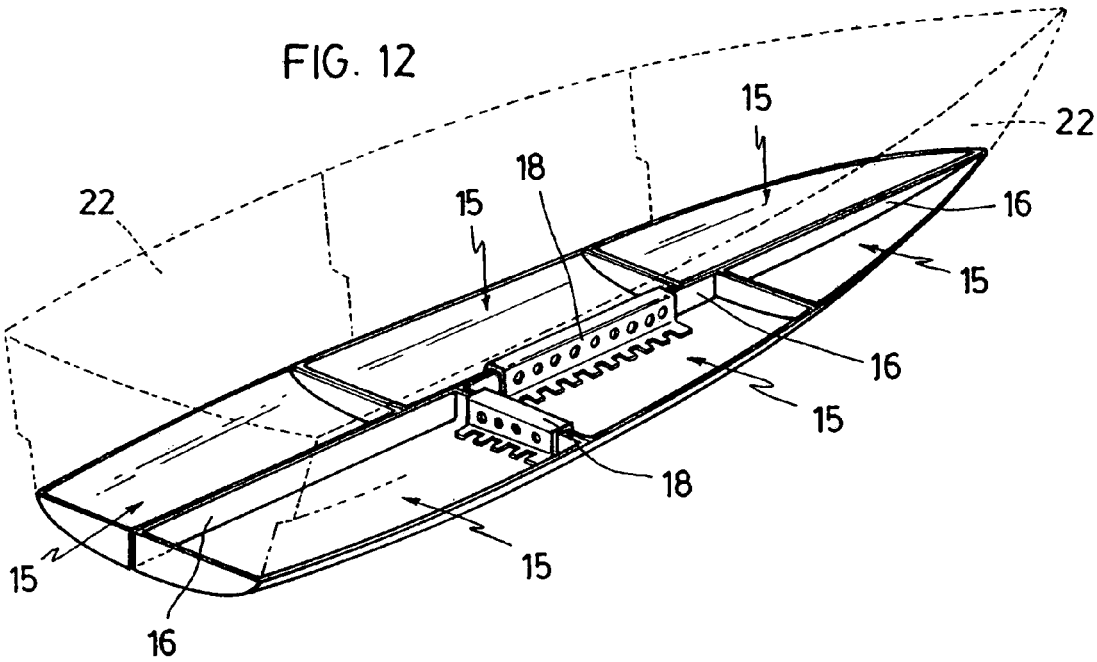
Figure 13:
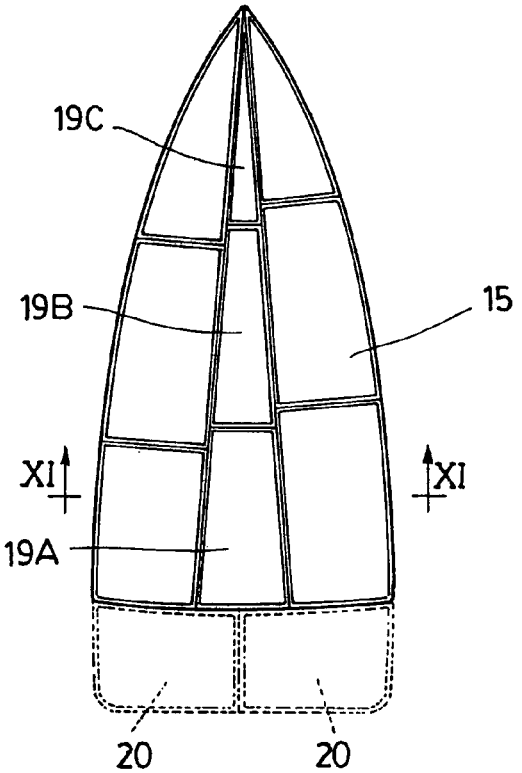
Figure 14:
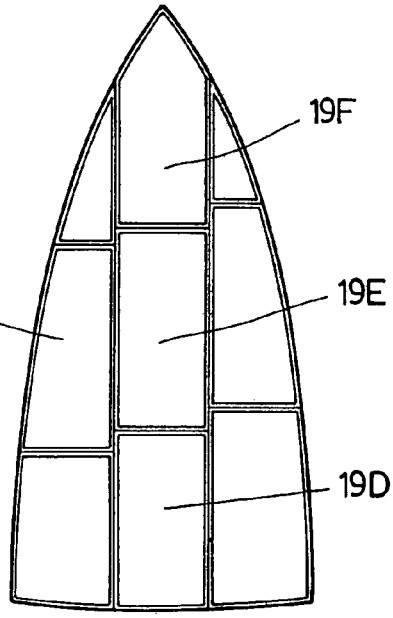
Figure 15:
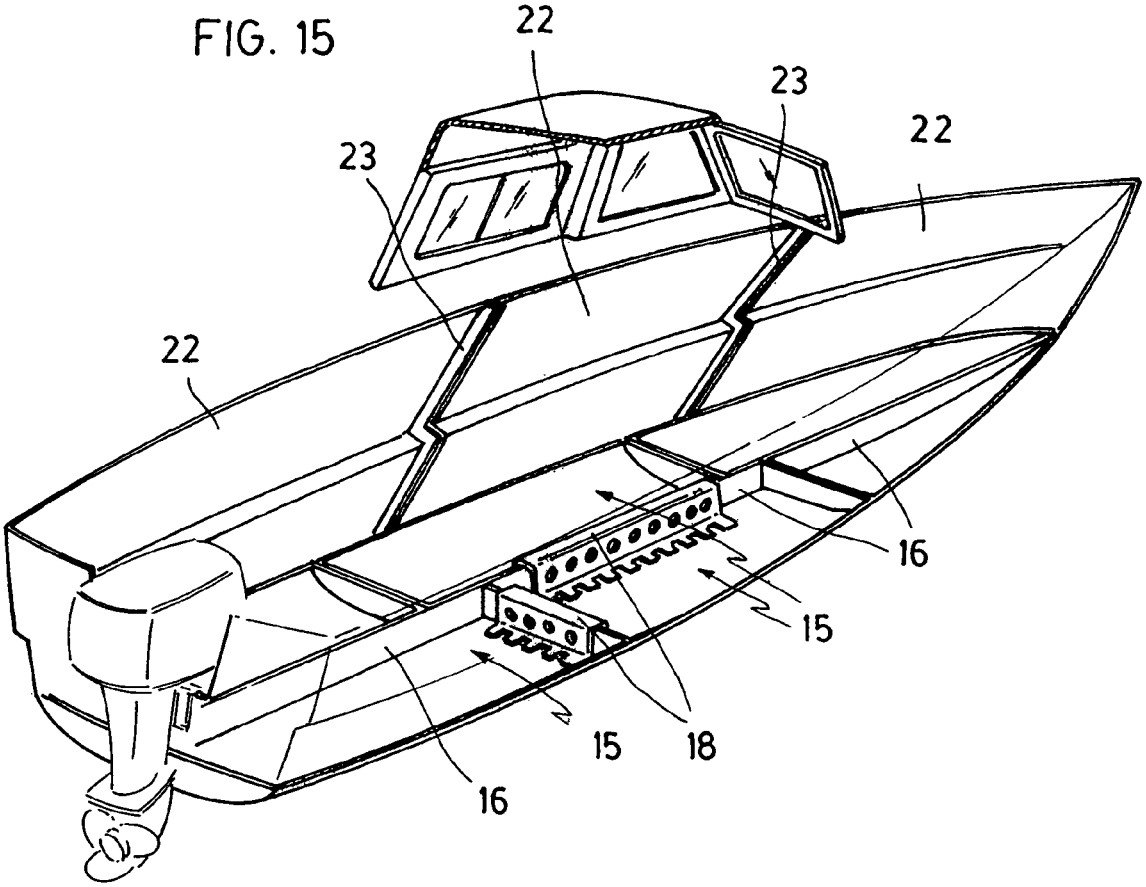
Figure 16:
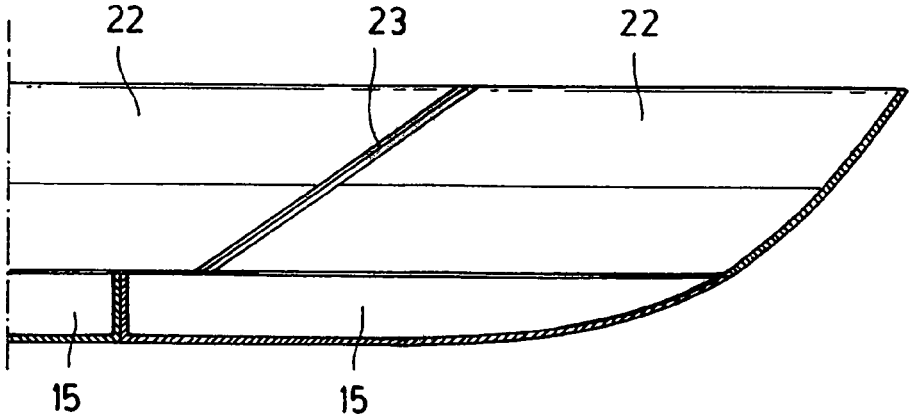

FIG. 6, diagrammatically illustrates in side elevation, the positive or convex mold part of FIG. 5, modeling a part serving as the second negative mold;

FIG. 7, illustrates, in perspective, the second negative mold part mounted in a mold carrier;

FIG. 8, illustrates, in perspective, in A, a true-to-scale model from which a part is separated, in B, a negative obtained with said part in C, a mold obtained with said negative and, in D, a part obtained with said mold;

FIG. 9, illustrates, diagrammatically and in section, an arrangement for molding the parts of the three-dimensional laminar body according to one embodiment of the invention;

FIG. 10, illustrates, in an exploded perspective view, the coupling of two molded parts of a hull, by lamination, and completed with a clamped profile;

FIG. 11, illustrates a section through line XI-XI of FIG. 13;

FIG. 12, illustrates, diagrammatically, the bottom of a vessel's hull made according to one embodiment of the invention;

FIG. 13, illustrates, in a top plan view, a hull, such as that of FIG. 13, enlarged angularly in its beam through the central interpositioning of molded parts;

FIG. 14, illustrates, similarly to FIG. 13, a hull such as that of FIG. 12, in which the beam has been evenly widened, by central interpositioning of molded parts;

FIG. 15, illustrates, in a partly sectioned perspective view, a vessel's bottom, port side and part of the cabin; and FIG. 16, illustrates, in an elevation view, the starboard side of a vessel's upper-works, in which the head coupling configuration of two panels can be observed.

DETAILED DESCRIPTION OF THE INVENTION

The procedure according to the invention essentially consists in making a three-dimensional laminar body of large dimensions having substantially laminar walls, said walls requiring a finely finished visible face or working face, as concerns quality of surface, appearance, uniformity of color, resistance to wear and to possible mechanical or chemical aggression, etc.

A body having such features may constitute a prefabricated swimming pool, automobile bodywork, a vessel's hull, a covering for a building, or other products, especially those such as swimming pools and vessels of large dimensions that, disregarding the difficulties posed by factory construction, are often unfeasible to construct because of the impossibility of transporting them to the place where they will be installed or used.

In the following description, a three-dimensional laminar body of large dimensions to construct according to the process of the invention has been chosen by way of example to be that corresponding to a convex body, such as the bottom of a vessel's hull, but such as a swimming pool is also applicable, with pertinent modifications for obtaining a concave body.

Figure 1:
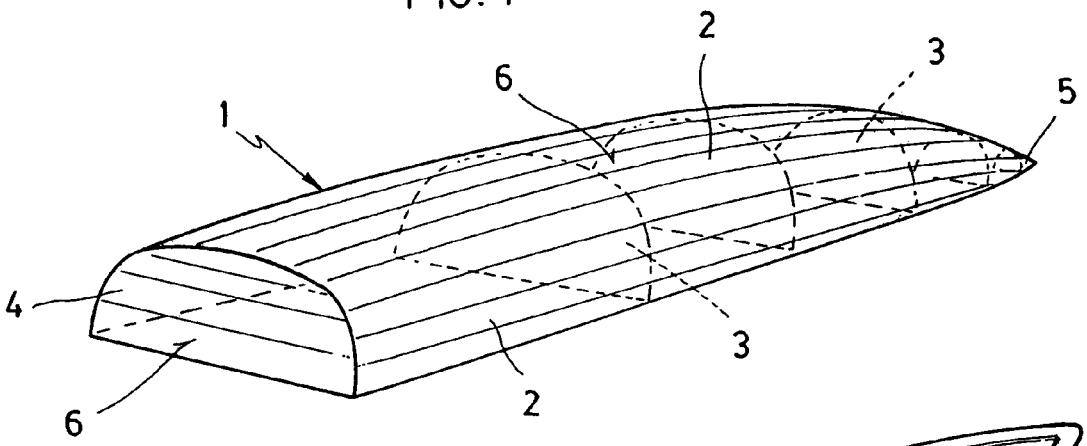
FIG. 1, illustrates, in perspective, a true-to-scale model of the three-dimensional laminar body to be obtained by modeling, consisting of the hull or bottom of a vessel.
Figure 2:
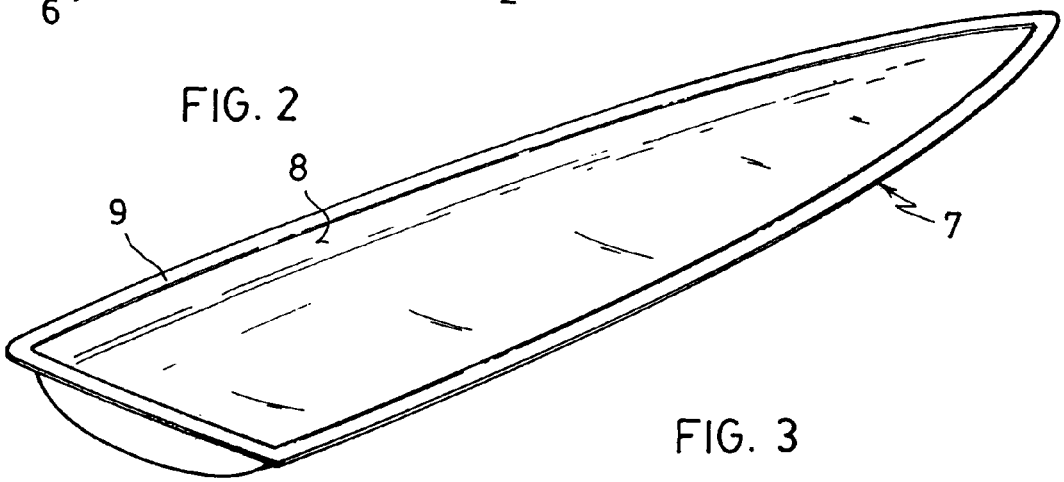
FIG. 2, illustrates, in perspective, a three-dimensional laminar body obtained by molding on the model of the previous figure.
Figure 3:
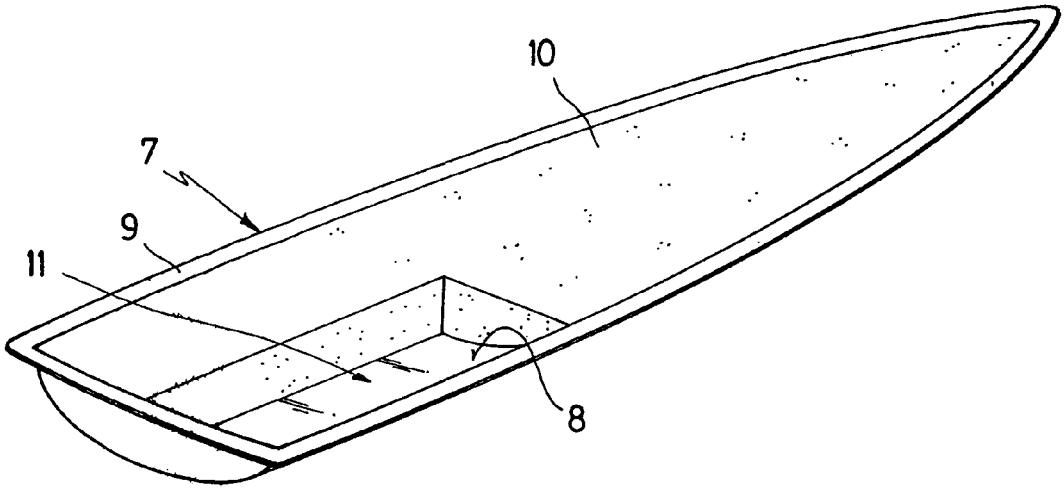
FIG. 3, illustrates, in perspective, the three-dimensional laminar body of FIG. 2 with the cavity thereof occupied by a filling that leaves a part of said cavity empty, serving as first negative or concave mold.
Figure 4:
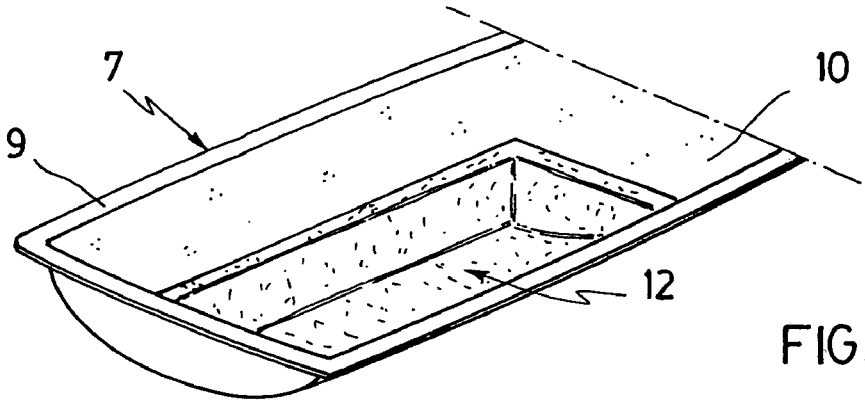
FIG. 4, illustrates, in perspective, molding in the first negative mold shaped in the body of FIG. 3.

The process according to the invention comprises the following operations:

a.—Make in wood, metal, plastic or other suitable material, a true-to-scale model 1 of the three-dimensional laminar body to be obtained, which comprises the entire body or parts thereof, such as shown in FIG. 1, in which can be observed the bottom of a vessel's hull constructed with planks 2 mounted on frames 3 and forming a stem 4 and a stern 5. These planks 2 are juxtaposed with respect to each other with a great deal of precision and the entire surface of the visible face 6 is polished. Similarly, the configuration of the model 1 can be obtained by robotic milling of a suitable block of material, using drawings, 3D computer-assisted design or other methods.

b.—Shape, manually or mechanically, on said model 1 a first negative mold 7, such as that shown in FIG. 2, which will have the configuration of model 1 in negative and will further have a surface 8 as polished as that of the visible face 6 of the model 1. A perimetric flange 9 is formed for handling and rigidification of said first negative mold 7. In the example shown, the first negative mold 7 has been formed such as to comprise the whole of model 1, however first negative molds can be formed which each comprise respective parts of model 1.

c.—From said first negative mold 7, one or several positive molds are obtained which reproduce the whole or part of the working surface of the three-dimensional laminar body to be obtained. For such, said first negative mold 7 is thus compartmentalized, as shown in FIG. 3, by filling said first negative mold 7 with a rigid foam mass 10, a part of which is removed to obtain a first partial negative mold 11, in which a positive mold 12 is molded, as shown in FIGS. 4 and 5. A similar result can be obtained by sequential compartmentalization of the first negative mold 7 by mobile partitions.

d.—A second negative mold 13 is shaped using said positive mold 12, as shown in FIG. 6, which is mounted in a mold carrier 14, as shown in FIG. 7, thus providing a suitable negative mold for reproducing parts corresponding to part of the model 1, the surface of the visible face or working face of said parts being of the same quality as that of model 1.

e.—Once all parts 15 corresponding to the different parts of model 1 and molded from the second negative molds 13 have been assembled, the coupling of such can be carried out by juxtaposition and mutual solid joining, as shown in FIG. 8, to constitute (a reproduction of), a three-dimensional laminar body,.the surface of the visible face or working face thereof having the same properties as regards shape and surface finish as the model 1.

According to a simplification of the process of the invention, the operations which comprise such are as follows:

1.—Make in wood or other suitable material a model 1A of the true-to-scale surface of the three-dimensional laminar body to be obtained, or a part thereof, by the same techniques described in the previous paragraph a).

2.—Divide, as shown in FIG. 8(A), said model 1A in parts, such as part 12A, which acts as positive mold, and as observed in (B) is used to shape, manually or mechanically, a negative mold 13 which is mounted in a mold carrier 14, as shown in FIG. 8(C), which is in turn used to mold a part 15 corresponding to the part of model 1, such as detailed in the above paragraph d).

3.—The various parts 15 are assembled, as shown in FIG. 8(D), proceeding as indicated in the above paragraph e).

A manner of mechanically molding the parts 15 is illustrated diagrammatically in FIG. 9, which shows a mold 24 on which is deposited a fiberglass layer 25, subsequent to wetting the molding surface with a mold release agent and applying a gel-coat resin to the molding surface, a countermold 26 is then applied, such being preferably formed by a thick sheet of flexible elastomer, which closes the mold 24 and seals it to a certain degree, thus establishing a space, with respect to the molding surface, in which the fiberglass layer 25 is compacted by communication established with a vacuum installation through conducts 27 and flexible tubing 28 whilst supply of resin is carried out by the entry 29, and distribution of said resin in the fiberglass layer 25 is facilitated, such being aided by a slight resin delivery pressure and/or the action of the vacuum.

A gel-coat resin is projected on the molding surface prepared with a mold release agent, after which is deposited the fiberglass layer 25, such being in the form of staple fiber, matted continuous filament, or fabric.

The parts 15, among other possible arrangements, are provided with perimetric flanges 16, lacking a fine finish, which can have complementary projections (or receptacles) for mutual coupling (not shown) and which couple with each other with the interposition of a seal 17 for water-tightness and adhesion complemented by a metallic clamp 18, capable of being provided with bolted or riveted systems etc. and being laminated with polyester resin reinforced with fiberglass, as shown in FIG. 9, or being joined simply by manual lamination.

The molding of the first and second negative molds 7, 13 and that of the positive molds 12, can be performed manually or mechanically, using in the latter case a programmable robot which applies the constitutive material for the molds and the final parts of the three-dimensional laminar body to be obtained.

The bottom of a vessel's hull such as that shown in FIG. 12 receives the sides of the hull 16 and on these the deck (not shown). However the configuration shown in FIG. 12 can be varied by interpositioning wedge parts 19A, 19B and 19C or parts 19D, 19E and 19F as shown in FIGS. 13 and 14, and complementing the stem with two parts 20. It should be mentioned that such parts 19 and even the stem parts 20, can form a keel 21, as may be observed in FIG. 11.

FIG. 15 shows the possibility of mounting on a given hull a separately chosen deck, such as that for recreational vessels, sports fishing, etc.

As concerns parts 22 of the upper-works, it is suitable that the vertical joints 23 be inclined and staggered with respect to those of the bottom, as shown in FIG. 16.

That which is claimed:

1. A method of constructing a reproduction of a three-dimensional laminar body having a finished outer surface, comprising:

forming at least one first negative mold on a full scale model of the three-dimensional laminar body;

compartmentalizing the at least one first negative mold into juxtaposed first negative mold portions, the first negative mold portions being configured to cooperate to collectively define the entire outer surface of the three-dimensional laminar body;

forming a positive mold on each of the first negative mold portions;

forming a second negative mold on each of the positive molds, each second negative mold being configured to have a finished surface defining a portion of the three-dimensional laminar body, whereby the second negative molds are configured to be cooperable to collectively define the three-dimensional laminar body, including the outer surface thereof, and forming a portion of a reproduction of the three-dimensional laminar body on each of the second negative molds, each portion of the reproduction having a finished outer surface in correspondence with the corresponding second negative mold, contiguous portions of the reproduction thereby being joinable to form the reproduction of the three-dimensional laminar body.

2. A method according to claim 1, wherein compartmentalizing the at least one first negative mold further comprises delimiting the at least one first negative mold by filling the at least one first negative mold with a conforming rigid mass, and then removing a portion of the rigid mass, the portion of the first negative mold having the portion of the rigid mass removed therefrom thereby defining one of the first negative mold portions.

3. A method according to claim 1, wherein compartmentalizing the at least one first negative mold further comprises delimiting the at least one first negative mold by dividing the at least one negative mold with at least one partition inserted therein, the portion of the at least one first negative mold divided by the at least one partition thereby defining one of the first negative mold portions.

4. A method according to claim 1, wherein compartmentalizing the at least one first negative mold further comprises delimiting the at least one first negative mold such that each first mold portion includes a continuous perimetric flange extending thereabout, the perimetric flanges being reproduced in the corresponding portions of the reproduction formed on the second negative molds, whereby the perimetric flanges of contiguous portions of the reproduction are complementarily configured and capable of being coupled together.

5. A method according to claim 4, further comprising coupling the complementary perimetric flanges of contiguous portions of the reproduction together by interposing a seal therebetween and applying a clamp device across the flanges.

6. A method according to claim 4, wherein the perimetric flange of each of the portions of the reproduction include at least one of a projection and a receptacle, the projection and receptacle being complementarily configured with respect to each other, and the method further comprises engaging the flanges of contiguous portions of the reproduction such that the projection of the flange of one portion engages the receptacle of the flange of the other portion so as to align the contiguous portions.

7. A method according to claim 1, wherein the reproduction of the three-dimensional laminar body comprises a substantially below-waterline portion of a vessel hull and a substantially above-waterline portion of the vessel hull, the substantially above-waterline and substantially below-waterline portions being configured to be coupled together, each of the substantially above-waterline and substantially below-waterline portions being comprised of a plurality of molded parts, and the method further comprises coupling contiguous molded parts of the substantially above-waterline portion together and coupling contiguous molded parts of the substantially below-waterline portion together, the contiguous molded parts of the substantially above-waterline portion being configured to have inclined joints formed therebetween, whereby the inclined joints of the substantially above-waterline portion are staggered with respect to joints between the contiguous molded parts of the substantially below-waterline portion.

* * * * *

UNITED STATES PATENT AND TRADEMARK OFFICE

CERTIFICATE OF CORRECTION

PATENT NO. : 7,374,708 B2
APPLICATION NO. : 10/495372
DATED : May 20, 2008
INVENTOR(S) : Carlos Fradera Pellicer It is certified that error appears in the above-identified patent and that said Letters Patent is hereby corrected as shown below:

Column 6

Line 20: “continuous” should read --contiguous--

Signed and Sealed this

Nineteenth Day of August, 2008

JON W. DUDAS
*Director of the United States Patent and Trademark Office*